US011104162B2

(12) United States Patent
Donaldson

(10) Patent No.: US 11,104,162 B2
(45) Date of Patent: Aug. 31, 2021

(54) METHOD, APPARATUS, DEVICE AND SYSTEM FOR CORRECTION OF ENCODER RUNOUT

(71) Applicant: Xerox Corporation, Norwalk, CT (US)

(72) Inventor: Patricia Joanne Donaldson, Pittsford, NY (US)

(73) Assignee: XEROX CORPORATION, Norwalk, CT (US)

( * ) Notice: Subject to any disclaimer, the term of this patent is extended or adjusted under 35 U.S.C. 154(b) by 0 days.

(21) Appl. No.: 16/932,222

(22) Filed: Jul. 17, 2020

(65) Prior Publication Data

US 2020/0346472 A1 Nov. 5, 2020

Related U.S. Application Data

(62) Division of application No. 16/113,572, filed on Aug. 27, 2018, now Pat. No. 10,717,305.

(51) Int. Cl.

| | |
|---|---|
| ***B41J 29/38*** | (2006.01) |
| ***B41J 11/42*** | (2006.01) |
| ***B41J 2/045*** | (2006.01) |
| ***B41J 13/00*** | (2006.01) |

(52) U.S. Cl.
CPC ..... *B41J 13/0009* (2013.01); *B41J 2/04536* (2013.01); *B41J 29/38* (2013.01)

(58) Field of Classification Search
CPC ..... B41J 29/38; B41J 2/2135; B41J 2/04505; B41J 2/04536; B41J 2/04573; B41J 11/42; B41J 11/44; B41J 11/46
See application file for complete search history.

(56) References Cited

U.S. PATENT DOCUMENTS

| | | | |
|---|---|---|---|
| 7,530,657 B2 * | 5/2009 | Thiessen | H04N 1/0473 347/16 |
| 8,162,428 B2 | 4/2012 | Eun et al. | |
| 8,251,504 B2 | 8/2012 | Viturro et al. | |

(Continued)

*Primary Examiner* — Scott A Richmond
(74) *Attorney, Agent, or Firm* — Fay Sharpe LLP

(57) ABSTRACT

Methods, Apparatus, Devices and Systems herein load a firing distance into a distance counter of a printing device. The firing distance is the distance from the current position of a printhead of the printing device to a marking location on a substrate and the distance is calculated based on an angular encoder operatively associated with a roller used to transport a marking media to the printhead for marking. These devices and methods count the firing distance in angular distance increments as a function of the encoder angular position to correct for encoder roller runout using the distance counter, based on relative movement of the substrate and printhead. When the distance counter reaches the last discrete distance increment corrected for encoder roller runout of the firing distance, these devices and methods load the fractional remaining distance of the firing distance into a time counter of the printing device. Then, the fractional remaining distance is counted using velocity-based distance increments at regular time intervals using the time counter. When the time counter reaches the last velocity-based calculated distance increment of the fractional remaining distance, the marking material is transferred from the printhead to the substrate.

18 Claims, 8 Drawing Sheets
(1 of 8 Drawing Sheet(s) Filed in Color)

(56) References Cited

U.S. PATENT DOCUMENTS

| | | | | |
|---|---|---|---|---|
| 8,303,071 | B2 | 11/2012 | Eun | |
| 8,328,315 | B2 | 12/2012 | Eun et al. | |
| 8,346,503 | B2 | 1/2013 | Eun et al. | |
| 8,491,081 | B2 | 7/2013 | Leighton et al. | |
| 8,567,894 | B2 | 10/2013 | Viturro et al. | |
| 8,814,300 | B2 | 8/2014 | Shin et al. | |
| 8,833,927 | B2 | 9/2014 | Leighton et al. | |
| 8,870,331 | B2 | 10/2014 | Mo et al. | |
| 8,888,225 | B2 | 11/2014 | Donaldson et al. | |
| 8,967,789 | B2 | 3/2015 | Mandel et al. | |
| 9,022,500 | B2 | 5/2015 | Leighton et al. | |
| 9,278,531 | B1 | 3/2016 | LeFevre et al. | |
| 9,409,389 | B1 * | 8/2016 | Donaldson | B41J 2/2135 |
| 9,844,961 | B1 | 12/2017 | Mantell et al. | |
| 2007/0126837 | A1 * | 6/2007 | Takahashi | B41J 11/007 347/104 |
| 2007/0229562 | A1 | 10/2007 | Doherty et al. | |
| 2011/0252992 | A1 * | 10/2011 | Viturro | B41J 15/04 101/484 |
| 2017/0182800 | A1 | 6/2017 | Chanclon et al. | |

* cited by examiner

METHOD, APPARATUS, DEVICE AND SYSTEM FOR CORRECTION OF ENCODER RUNOUT

This application is a Division of U.S. application Ser. No. 16/113,572; filed Aug. 27, 2018 (US Publication No. 2020/0062010A1), now U.S. Pat. No. 10,717,305, issued Jul. 21, 2020.

CROSS REFERENCE TO RELATED PATENTS AND APPLICATIONS

U.S. Pat. No. 9,409,389, by Donaldson et al., issued Aug. 9, 2016 and entitled "COORDINATION OF PRINTHEADS/SUBSTRATE POSITION WITH TRANSFER OF MARKING MATERIAL" is incorporated herein by reference in its entirety.

BACKGROUND

Systems and methods herein generally relate to printing devices, and more particularly to the coordination of the printhead/substrate position with the transfer of marking material from the printhead to the substrate.

In printing devices, it can be difficult to accurately register drops in the process direction, and ensure that drops from separated heads are printed at the required absolute location, especially for 3-dimensional printing. Printheads, such as inkjet printheads, fire when they receive a signal, such as a dot clock signal to cause marking material to be applied to a substrate, such as print media, a plate or platform, etc., to produce printed media, form 3-D items, etc.

Ink-jet printers fire drops of ink from the head in response to a clock signal. The clock signal is generated based on encoder feedback. Frequently drive-shaft mounted encoders are not perfectly co-axial, leading to a sinusoidal runout error in encoder spacing. For a continuous feed press, this can be corrected by generating a runout correction table by printing extremely long (20 m) test patterns and analyzing them with an image sensor. For a cut-sheet or 3D printing system, printing long test patterns is not possible.

This disclosure uses the measured time (for example, a number of 100 MHz clock counts) between encoder tics to measure runout and generate runout correction tables/functions to accurately calculate the positions of the media transport as a function of an angular position of the encoder roll. The time between tics is a strong function of the transport velocity, however averaging over many encoder roll revolutions allows a correction to be calculated accurately.

INCORPORATION BY REFERENCE

U.S. Pat. No. 9,844,961, by Mantell et al., issued Dec. 19, 2017 and entitled "SYSTEM AND METHOD FOR ANALYSIS OF LOW-CONTRAST INK TEST PATTERNS IN INKJET PRINTERS";

U.S. Pat. No. 9,278,531, by LeFevre et al., issued Mar. 8, 2016 and entitled "PRINT HEAD PROTECTION DEVICE FOR INKJET PRINTERS";

U.S. Pat. No. 9,022,500, by Leighton et al., issued May 5, 2015 and entitled "SYSTEM AND METHOD FOR ADJUSTING THE REGISTRATION OF AN IMAGE APPLIED TO RECORDING MEDIA IN A PRINTING SYSTEM";

U.S. Pat. No. 8,967,789, by Mandel et al., issued Mar. 3, 2015 and entitled "SPREADER/TRANSFIX SYSTEM FOR HANDLING TABBED MEDIA SHEETS DURING DUPLEX PRINTING IN AN INKJET PRINTER";

U.S. Pat. No. 8,888,225, by Donaldson et al., issued Nov. 18, 2014 and entitled "METHOD FOR CALIBRATING OPTICAL DETECTOR OPERATION WITH MARKS FORMED ON A MOVING IMAGE RECEIVING SURFACE IN A PRINTER";

U.S. Pat. No. 8,870,331, by Mo et al., issued Oct. 28, 2014 and entitled "SYSTEM AND METHOD FOR PROCESS DIRECTION ALIGNMENT OF FIRST AND SECOND SIDE PRINTED IMAGES";

U.S. Pat. No. 8,833,927, by Leighton et al., issued Sep. 16, 2014 and entitled "PRINTER HAVING SKEWED TRANSFIX ROLLER TO REDUCE TORQUE DISTURBANCES";

U.S. Pat. No. 8,814,300, by Shin et al., issued Aug. 26, 2014 and entitled "SYSTEM AND METHOD FOR SUBPIXEL INK DROP ADJUSTMENT FOR PROCESS DIRECTION REGISTRATION";

U.S. Pat. No. 8,567,894, by Viturro et al., issued Oct. 29, 2013 and entitled "REFLEX PRINTING WITH TEMPERATURE FEEDBACK CONTROL";

U.S. Pat. No. 8,491,081, by Leighton et al., issued Jul. 23, 2013 and entitled "SYSTEM AND METHOD FOR COMPENSATING FOR ROLL ECCENTRICITY IN A PRINTER";

U.S. Pat. No. 8,346,503, by Eun et al., issued Jan. 1, 2013 and entitled "SYSTEM AND METHOD FOR EQUALIZING MULTIPLE MOVING WEB VELOCITY MEASUREMENTS IN A DOUBLE REFLEX PRINTING REGISTRATION SYSTEM";

U.S. Pat. No. 8,328,315, by Eun et al., issued Dec. 11, 2012 and entitled "SYSTEM AND METHOD FOR SWITCHING REGISTRATION CONTROL MODES IN A CONTINUOUS FEED PRINTER";

U.S. Pat. No. 8,303,071, by Eun, issued Nov. 6, 2012 and entitled "SYSTEM AND METHOD FOR CONTROLLING REGISTRATION IN A CONTINUOUS FEED TANDEM PRINTER";

U.S. Pat. No. 8,251,504, by Viturro et al., issued Aug. 28, 2012 and entitled "REFLEX PRINTING WITH TEMPERATURE FEEDBACK CONTROL"; and U.S. Pat. No. 8,162,428, by Eun et al., issued Apr. 24, 2012 and entitled "SYSTEM AND METHOD FOR COMPENSATING RUNOUT ERRORS IN A MOVING WEB PRINTING SYSTEM", are incorporated herein by reference in their entirety.

BRIEF DESCRIPTION

In one embodiment of this disclosure, described is a printing apparatus comprising: one or more printheads; a processor operatively connected to the one or more printheads; a substrate transport operatively connected to the processor, the substrate transport including a transport belt driven in a process direction towards the one or more printheads and the substrate transport including an encoder and encoder roller operatively associated with detecting a plurality of discrete angular positions of the encoder roller representative of a distance traveled by the transport belt in the process direction towards the one or more printheads for making a substrate with marking material carried by the transport belt; and a distance calculator operatively connected to the processor, the distance calculator calculating a distance to be traveled by the transport belt measured by the encoder for marking the substrate with a printhead at a respective printhead firing distance, the distance calculator determining a current angular position of the encoder roller and accessing encoder runout distance data providing distances between discrete angular positions of the transport roller generated by measuring a clock count of an associated clock between discrete angular positions of the encoder to calculate respective distances between discrete angular positions of the encoder roller.

In another embodiment of this disclosure, described is a method for correcting for encoder runout associated with a printing device comprising: loading a firing distance into a distance counter of the printing device, the firing distance being a distance from a current position of a printhead of the printing device to a marking location on a substrate; the distance counter counting the firing distance in discrete distance increments using encoder runout distance data based on a clock count between discrete angular positions of a transport roller and representative of distances between discrete angular positions of a transport roller operatively associated with the printing device, based on relative movement of said substrate and said printhead; loading a fractional remaining distance of the firing distance into a time counter of the printing device when the distance counter reaches a last discrete distance increment of the firing distance; counting the fractional remaining distance based on velocity-based calculated distance increments at regular time intervals using the time counter; and transferring material from the printhead to the substrate when the time counter reaches a last velocity-based distance increment of the fractional remaining distance.

In yet another embodiment of this disclosure, described is a method for correcting for encoder runout associated with a printing device comprising: loading a firing distance into a distance counter of the printing device, the firing distance being a distance from a current position of a printhead of the printing device to a marking location on a substrate; the distance counter counting the firing distance in discrete distance increments using encoder runout distance data based on a clock count between discrete angular positions of a transport roller and representative of distances between discrete angular positions of a transport roller operatively associated with the printing device, based on relative movement of said substrate and said printhead; loading a fractional remaining distance of the firing distance into a time counter of the printing device when the distance counter reaches a last discrete distance increment of the firing distance and adding a next firing distance of a subsequent marking location and the fractional remaining distance to the distance counter; counting the fractional remaining distance based on velocity-based distance increments at regular time intervals using the time counter; transferring material from the printhead to the substrate when the time counter reaches a last velocity-based distance increment of the fractional remaining distance; and repeating the counting of the firing distance, the loading of the fractional remaining distance, the counting of the fractional remaining distance, and the transferring of the material for the subsequent marking location.

BRIEF DESCRIPTION OF THE DRAWINGS

The patent or application file contains at least one drawing executed in color. Copies of this patent or patent application publication with color drawing(s) will be provided by the Office upon request and payment of the necessary fee.

DETAILED DESCRIPTION

Figure 1:
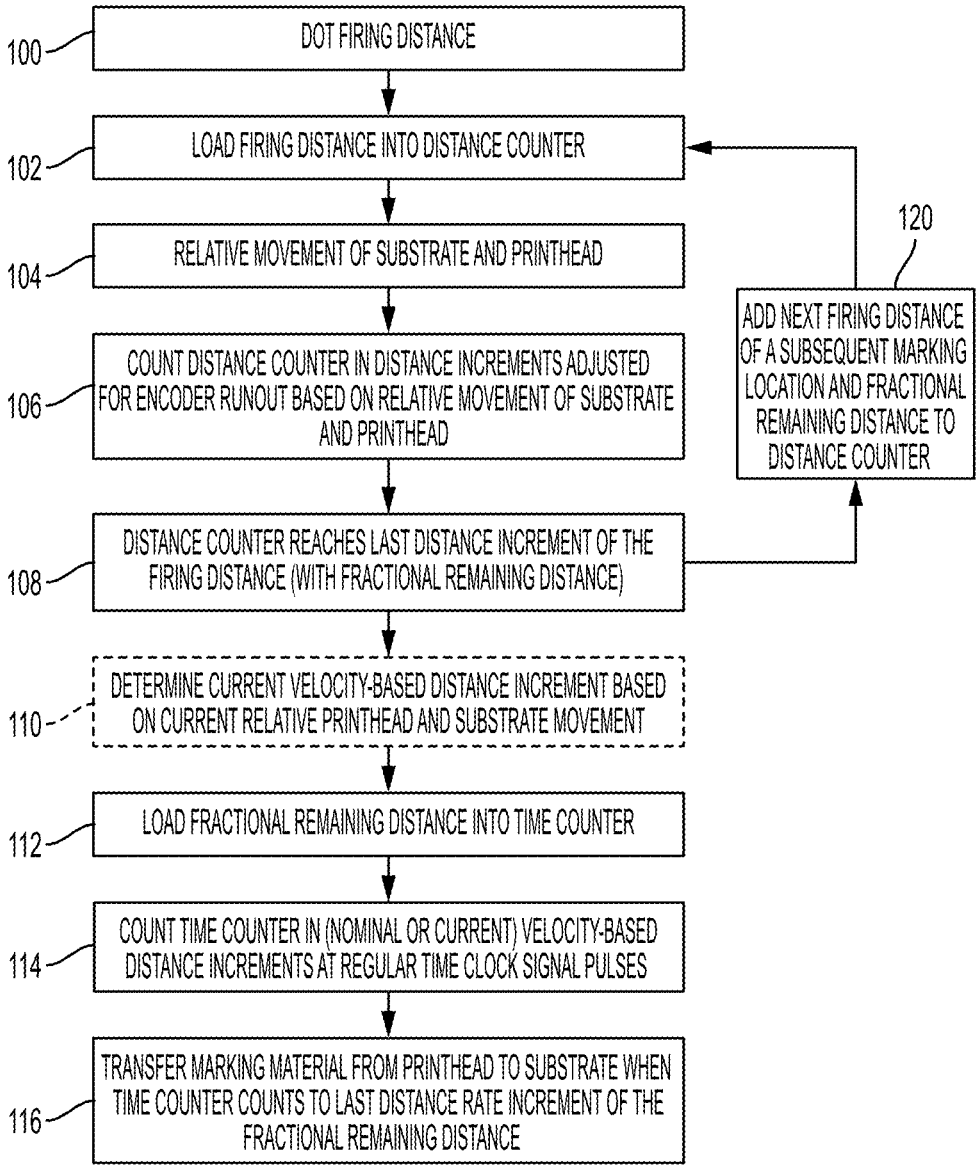
FIG. 1 is a flow chart of a method for correction of encoder runout associated with a printing system according to an exemplary embodiment of this disclosure.

Various methods, apparatuses, devices and systems herein load a dot "firing distance" into a distance counter (e.g., primary encoder) of a printing device. The firing distance is the distance from the current position of a printhead to a marking location on a substrate, and can be supplied from a previously determined item (such as a bitmap and/or dot spacing requirement, etc.), or can be calculated in real time.

The disclosed methods, apparatuses, devices and systems count the firing distance in discrete distance increments using a distance counter corrected for encoder runout, based on relative movement of the substrate and the printhead (e.g., based on "tics" counted by a physical item rotating or moving within the printing device). When the distance counter reaches the last discrete distance increment of the firing distance, these methods, apparatuses, devices and systems load the fractional remaining distance of the firing distance into a time counter (e.g., secondary encoder) of the printing device. The fractional remaining distance is a distance less than one of the discrete distance increments corrected for encoder runout and counted by the distance counter.

Then, the fractional remaining distance is generated using velocity-based calculated distance increments at regular time intervals using the time counter. The regular time intervals corresponding to time signals received from a time clock of the printing device. The distance value of each velocity-based distance increment is calculated, based on the current relative velocity between the printhead and the substrate (and the time signal rate output by the time clock); or a nominal (previously calculated) velocity-based distance increment can be used. When the time counter reaches the last velocity-based distance increment of the fractional remaining distance, the marking material is transferred from the printhead to the substrate.

Also, such methods, apparatuses, devices and systems can optionally add the next firing distance of a subsequent marking location to the fractional remaining distance, when the fractional remaining distance is transferred to the time counter, and load the sum to the distance counter before repeating the processes of counting the firing distance, loading the fractional remaining distance, counting the fractional remaining distance, and transferring the marking material for the subsequent marking location.

Printing apparatuses and devices herein include, among other components, any form of printhead, a processor operatively (meaning directly or indirectly) connected to the printhead, a substrate support operatively connected to the processor, etc. The substrate support can include rollers, a plate or platform, etc., that supports a substrate adjacent to the printhead. The printhead transfers (e.g., ejects, releases, disperses, forces, directs etc.) material in discrete units (e.g., dots, drops, droplets, pixels, etc.) toward, or on to the substrate, such as a cut-sheet.

Further, such printing apparatuses and devices include a primary encoder (e.g., distance counter); a secondary encoder (e.g., a time counter) also operatively connected to the processor; and a time clock operatively connected to the time counter. The primary encoder counts in discrete distance increments as the substrate moves relative to the printhead, and the time counter counts using velocity-based calculated distance increments at regular time intervals. The regular time intervals correspond to time signals received by the time counter from the time clock.

The processor loads a firing distance into the distance counter. The firing distance is the distance from the current position of the printhead to a marking location on the substrate. The distance counter counts the firing distance in the discrete distance increments, based on relative movement of the substrate and the printhead.

The processor loads the fractional remaining distance of the firing distance into the time counter when the distance counter reaches the last discrete distance increment of the firing distance. The fractional remaining distance is less than one of the discrete distance increments. The time counter counts the fractional remaining distance in the velocity-based distance increments at the regular time intervals. The processor can determine the velocity-based calculated distance increments based on the current relative velocity between the printhead and the substrate. Then, the printhead transfers the marking material to the substrate when the time counter reaches the last velocity-based calculated distance increment of the fractional remaining distance.

The processor can optionally, at the time that the fractional distance is transferred to the time counter, add the next firing distance of a subsequent marking location and the fractional remaining distance, and supply the sum to the distance counter, when the printing apparatus repeats the processes of counting the firing distance, loading the fractional remaining distance, counting the fractional remaining distance, and transferring the marking material for the subsequent marking location.

These and other features are described in, or are apparent from, the following detailed description.

As mentioned above, printheads (such as inkjet printheads) fire when they receive a signal. There are various techniques for firing dot clocks. Some printers fire directly on an encoder signal. This gives a single firing resolution (dots-per-inch), but ties the firing directly to an absolute location on the encoder, so there is no drift. Other methods calculate the velocity of the substrate at intervals, and then fire dot clocks by integrating the velocity over time.

The devices and methods herein use a hybrid approach, which retains the advantages of variable dot spacing and runout correction, while eliminating drift. The devices and methods herein combine a primary distance "clock" that decrements, not on time units, but only when an encoder tic (produced by a physical item moving) is detected, and a secondary time-driven clock, which is started when the primary distance-based clock is within a single encoder tic (e.g., angular position indicator of encoder roller) of the desired dot clock firing position. The secondary time-driven clock decrements in distance units that are based on the measured velocity of the substrate transport/media transport.

In some cases (such as with a drive-roll mounted encoder) the distance the substrate travels between encoder tics may not be the same at all encoder positions. This is particularly true for rotary encoders, where the encoder may not be mounted perfectly centered on a drive roll. In these cases, the distance the substrate moves between encoder tics may depend on the position of the encoder relative to some index location. The encoder will send out an index pulse when the encoder is at one absolute location (for a linear encoder) or angle of rotation (for a rotary encoder). The encoder position can be determined by counting tics past the index.

In order to accommodate this, with devices and methods herein, the distance increment is a function of the encoder position. For a rotary encoder according to an exemplary embodiment of this disclosure, a pair of sin and cos functions are generated during a power-up cycle at the printer or some other time and used to approximate the distance traveled per tic at different points on the roll. The sin and cos functions are based on logged encoder runout distance data which measures a clock count between tics. The sin and cos functions are subsequently used to generate a tic distance table indicating the distance between specific tics. The devices and methods herein apply the correction or apply the provided encoder runout tic distance data to the distance increment used by the primary counter.

The hybrid approach disclosed herein which includes corrections for encoder runout, maximizes dot clock spacing accuracy, allows for variable dot spacing, and also ensures accurate location, without drift, over the entire print zone. Therefore, with devices and methods herein, any errors in velocity are only integrated over a single encoder tic interval, which gives absolute position errors that are significantly less than a micron, and which do not accumulate over time.

As discussed above, the exemplary embodiments discussed herein generates an encoder runout angular distance correction function which is used to calculate the angular distance between tics as a function of the encoder angular position, i.e., tics post an encoder index. To generate this correction function, the measured time (for example, number of 100 MHz clock counts) between encoder tics is used to measure the encoder runout. While the time between tics is a strong function of the velocity, averaging over many encoder roll revolutions allows the correction function to be calculated accurately. This technique of determining encoder roll runout is especially useful in cut-sheet printing systems where long printed test patterns cannot be used. The disclosed correction can be achieved by simply running the encoder and counting the tics. According to an exemplary embodiment, Absolute Registration Code operatively associated with a control processor maintains a distance to the next dot clock which is decremented by the encoder tic distance each time a tic is detected. The index-corrected distance per tic is used in place of the nominal distance per tic. U.S. Pat. No. 9,409,389, by Donaldson et al., issued Aug. 9, 2016 and entitled "Coordination of printheads/substrate position with transfer of marking material" provides additional details of the Absolute Registration Code described herein.

The yRegistration (transport/process direction) FPGA (Field-Programmable Gate Array) code counts the number of yReg clocks between encoder marks. This information is transmitted to the yReg code at each interrupt, along with the total number of encoder counts. The encoder index position is also recorded, so that the number of counts past the index can be determined.

The disclosed encoder runout correction process averages the clock counts per tic for some interval of time past the index. As a result, over many encoder revolutions obtained is a direct measure of the relative distance between tics around the encoder roll. According to an exemplary embodiment, the time between tics is separated out into sin and cos terms (or a magnitude+phase). The sin/cos terms are used to generate a table of tic distance vs encoder position, and the corrected distance per tic is downloaded to the FPGA at each interrupt, and used in the Absolute yRegistration algorithm. While the described implementation includes the use of sin and cos functions to fit averaged data, other exemplary embodiments include the use of the measured values directly, or other smoothing functions, such as a cubic interpolation to estimate the distance traveled for each encoder tic.

The absolute yRegistration code maintains a distance to the next dot clock which is decremented by the encoder tic distance each time a tic is detected. The index-corrected distance per tic is used in place of the nominal distance per tic.

Figure 2:
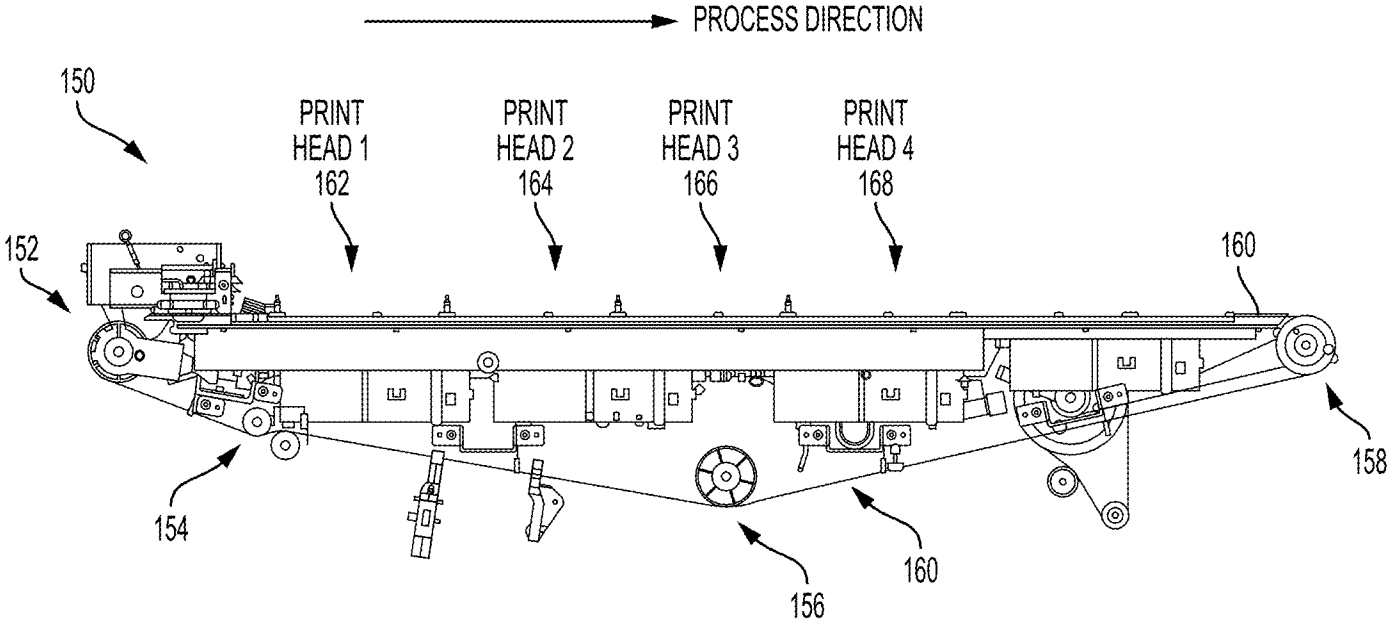
FIG. 2 is a diagram of a media transport and associated printhead marking station including an encoder according to an exemplary embodiment of this disclosure.
Figure 8:
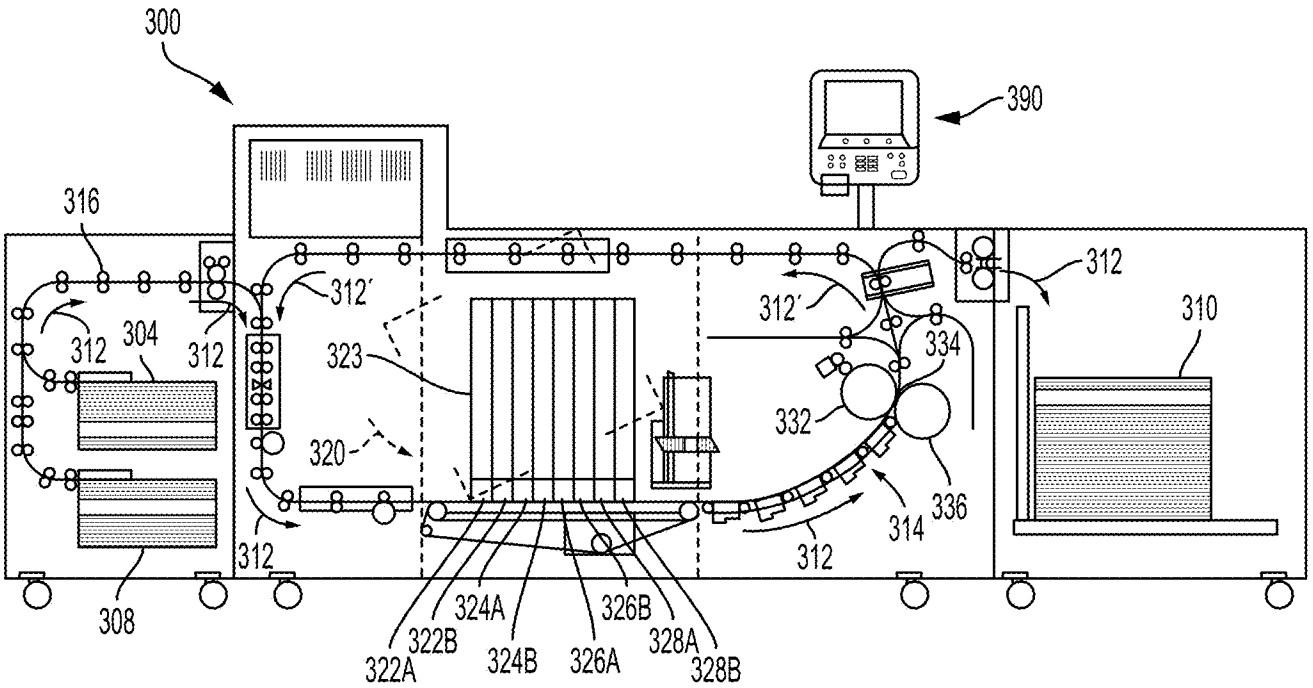
FIG. 8 is a diagram of a printing system including an encoder arrangement associated with media transport rollers according to an exemplary embodiment of this disclosure.

FIG. 1 is a flowchart illustrating an exemplary method herein that performs automated operations that do not require user input. FIG. 2 is a diagram of a media transport 150 including an encoder/encoder roller arrangement, the media transport 150 including a media cut-sheet transport belt 160, a steering mechanism 152, a reflex roller 154, a belt tensioner roller 156, and a transport bolt drive roller 158 and printheads 162, 164, 166 and 168. An encoder/encoder roller arrangement, for example as shown in FIG. 8, is incorporated into the reflex roll 154 or drive roll 158 locations of the media transport 150. More specifically (as shown in FIG. 1) in step 100, the method starts with a dot "firing distance" to an initial or the next dot that is to be printed. The firing distance is the distance from the current position of a printhead of the printing device to a marking location on a substrate, and can be supplied from a previously determined item (such as a bitmap and/or dot spacing requirement); or can be calculated in real time. In step 102, the method loads the firing distance into a distance counter (e.g., primary encoder) of a printing device.

The marking location identifies the point at which the printhead transfers (e.g., ejects, releases, disperses, forces, directs, etc.) marking material in discrete units (e.g., dots, drops, droplets, pixels, etc.) toward, or on to the substrate. As would be understood by those ordinarily skilled in the art, a "dot of marking material" can comprise any portion (e.g., droplet, drop, pixel, etc.) of any type of marking material (e.g., liquid ink, solid ink, toner, magnetic ink, etc.); or any other base unit of marking material, whether currently known or developed in the future.

As shown in step 104, relative movement between the substrate and printhead can be caused by moving either, or both (using actuators, electromagnetic motors, hydraulic devices, pneumatic devices, gears, belts, rollers, etc.). All such physical devices can indicate movement through sensors, by detecting current draw, etc. Therefore, as these physical devices move, they output periodic signals indicating that the substrate and printhead have moved a distance increment relative to one another (measured in any distance units). Further, these devices and methods compensate for the physical irregularities of any devices by making the distance amount of the distance increment a function of the encoder position.

In step 106, the firing distance is counted in discrete distance increments using the distance counter and encoder runout distance data corrected for encoder runout, based on the relative movement of the substrate and the printhead in step 104 (e.g., based on "tics" counted by a physical step rotating or moving within the printing device), as well as the angular position of the encoder, i.e., encoder tic past encoder tic index. During the firing distance counting being performed in step 106, the distance counter will reach the last discrete distance increment of the firing distance in step 108. The last discrete distance increment will generally be zero, but could be arbitrarily set at any number or level. Stated more specifically, the last discrete distance increment will be the discrete distance increment that brings the firing distance to zero, or to a positive number that is less than one discrete distance increment.

Unless the firing distance is completely divisible by the discrete distance increment, corrected for encoder runout, there will be a fractional remaining distance of the firing distance in the distance counter after the distance counter counts to the last discrete distance increment in step 108. This fractional runout remaining distance is a distance less than the discrete encoder corrected distance increments counted by the distance counter. For example, if the firing distance is 10.25 distance units, and the error corrected total distance associated with the next 10 tics is 10.1 distance units, the distance counter will count down 10 discrete distance increments, leaving 0.15 distance units as the fractional remaining distance.

In step 110, optionally (shown using dashed lines) the distance is calculated using a velocity-based distance increment calculation, based on the current relative velocity between the printhead and the substrate (and the time signal rate output by the time clock); and this can be performed for each firing distance and each mark that is printed. In other words, the count within the primary encoder will occur at a rate over time based upon how fast the printhead and substrate are moving relative to one another, and step 110 determines the relative velocity based upon that rate corrected for based on the encoder runout as a function of the encoder tic angular position.

In step 110, the velocity of the printhead/substrate is divided by the rate of time signals produced by the time clock to arrive at the velocity-based calculated distance increment at which a time counter (e.g., secondary encoder) of the printing device will increment. Alternatively, step 110 can be skipped, and a nominal (previously calculated) velocity-based distance increment can be used which may or may not be calculated based on the encoder runout distance data. In either case, so long as the velocity of the printhead/substrate remains somewhat constant, during each clock pulse from the time clock used by the time counter, the distance between the printhead and the marking location will change by the same distance (e.g., the velocity-based distance) and each increment by the time counter represents this distance.

In step 112, the fractional remaining distance of the firing distance is loaded into the time counter (e.g., secondary encoder) of the printing device. Then, in step 114, the fractional remaining distance is counted using the velocity-based calculated distance increments which may or may not be error corrected for encoder runout, at regular time intervals, using the time counter. Again, the regular time intervals correspond to periodic, regular time signals received from a time clock of the printing device. As shown in step 116, when the time counter reaches the last velocity-based calculated distance increment of the fractional remaining distance (e.g., zero or the last positive number that is smaller than one velocity-based distance increment), the marking material is transferred from the printhead to the substrate to print a dot or mark on the substrate.

In step 120, the next firing distance of a subsequent marking location is added to the fractional remaining distance from step 108, and the sum of these distances is loaded to the distance counter (step 102) before repeating the processes of counting the firing distance, loading the fractional remaining distance, counting the fractional remaining distance, and transferring the marking material for the subsequent marking location. This step is done at the time that the fractional distance is transferred to the secondary distance counter. Thus, if an additional drop is fired, the dot spacing is added to the fractional remaining distance in the distance counter at the same time (or potentially immediately after) the fractional remaining distance is transferred to the time counter.

For example, the firing distance in step 100 can be, in this example, 10.25 distance units of any distance measurement (dots per inch (DPI), tics, inches, millimeters, microns, etc.); and this may be limited by the resolution of the printing device, the desired dot spacing, etc. The distance counter counts in "discrete" (meaning whole number) distance increments error corrected for encoder runout, and not fractions or portions of distance increments in step 106, and in this example decrements in increments of 1 distance unit, again error corrected for encoder runout. Therefore, the fractional remaining distance (step 108) of 0.25 distance units.

In other words, the printhead should disburse the drop of marking material 15/100 of the way into the 10th distance increment, to properly meet a requirement of counting to 10.25 distance increments of the primary encoder. Continuing with the same example, if the time counter begins counting down at a velocity-based calculated distance increment of 0.01 distance units from a starting count of 0.15 velocity-based distance increment to zero in step 114, after 15 velocity-based distance calculated increments, the time counter reaches the firing time increment, at which point step 116 disburses the dot of material from the printer to the substrate.

While the foregoing examples discuss that the distance counter and time counter can decrement from a higher value to a zero value, such examples are only used for convenience of illustration, and those ordinarily skilled in the art understand that the distance counter and time counter could decrement to a non-zero value, or could increment from a lower value (such as zero) to a higher value; or could decrement or increment from any value to a different value. For example, the distant counter and time counter could decrement from a value of 50 and stop at a value of 20, and similarly, the distance counter and time counter could increment from a value of 10 to a value of 20. Regardless of the type of counting performed by the distance counter and the time counter (up or down), when these counters reach a preset value (which could be zero, or a different number) they perform the action described in the flowchart shown in FIG. 1 by causing a remainder value (which could be relative to a non-zero number where counting stops) to be loaded into a different counter, or causing a printhead to transfer marking material, etc.

As previously discussed, it is critically important on an ink-jet printer to trigger the print heads when the paper has moved exactly one scanline (typically 1/600th of an inch). Print head firing is typically controlled using an encoder/encoder roller arrangement. However, errors in encoder mounting may cause errors in drop placement, which can show up as banding on the print caused by encoder roll runout.

Provided below are further details of methods, apparatuses, devices and systems to generate encoder runout distance data, i.e., the distance between specific tics or angular positions of an encoder roller, which is used to accurately determine a distance of travel of a substrate (such as a cut-sheet, continuous web sheet, or image transfer belt), as measured by encoder tic counts to trigger one or more printheads to make the substrate.

To calculate the encoder roll runout using a yRegistration log, and applying it using the absolute yRegistration code, the following steps are performed.

A) The yReg FPGA receives signals from an encoder, including the transitions on an A and B channel which represent "light to dark" and "dark to light" transitions of the encoder signal, plus the index location. After each YRegInterrupt clock cycles, the FPGA passes the following information up to the yReg application:

The number of encoder tics detected since the marker was cycled up (encoderCountLog);

The number of indexes detected since the marker was cycled up (indexCountLog); and The number of clock cycles between the last nEncoderAvg encoder tics (clkSumPrevLog).

A sample from a log is shown below:

| interruptId | encoderCountLog | indexCountLog | clkSumPrevLog | Tics past the index |
|---|---|---|---|---|
| 35039 | 2001501 | 100 | 398824 | 19698 |
| 35040 | 2001602 | 100 | 398824 | 19799 |
| 35041 | 2001702 | 100 | 398824 | 19899 |
| 35042 | 2001803 | 101 | 398824 | 0 |
| 35043 | 2001904 | 101 | 398824 | 101 |
| 35044 | 2002005 | 101 | 396608 | 202 |
| 35045 | 2002106 | 101 | 396608 | 303 |
| 35046 | 2002207 | 101 | 396608 | 404 |
| 35047 | 2002307 | 101 | 396608 | 504 |
| 35048 | 2002408 | 101 | 396608 | 605 |
| 35049 | 2002509 | 101 | 396608 | 706 |
| 35050 | 2002609 | 101 | 396608 | 806 |
| 35051 | 2002710 | 101 | 396608 | 907 |
| 35052 | 2002810 | 101 | 396608 | 1007 |
| 35053 | 2002910 | 101 | 396608 | 1107 |
| 35054 | 2003010 | 101 | 397830 | 1207 |

B) From the logged information, the approximate number of encoder tics past the index is determined.

Figure 3:
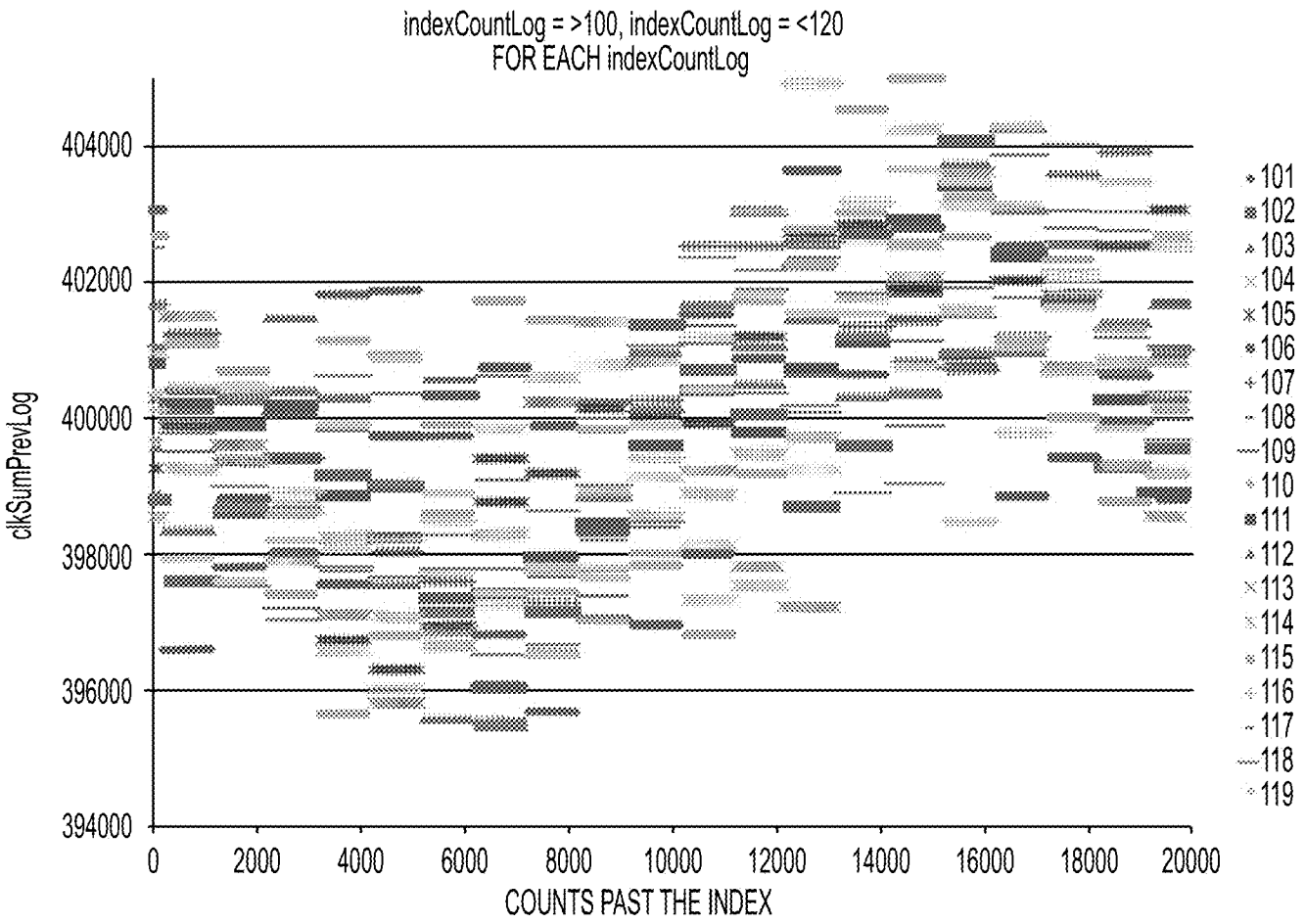
FIG. 3 is a graph of logged runout data associated with an encoder roll operatively associated with a media transport according to an exemplary embodiment of this disclosure.

The graph of FIG. 3 shows individual measurements for the clkSumPrevLog vs the tics past the index. As shown, there is considerable spread in these measurements caused by velocity variation. As the transport is running faster, the number of clock counts between encoder tics decreases. However, even with the velocity variation, the sinusoidal error in the clock counts due to the encoder runout is clear.

Figure 4:
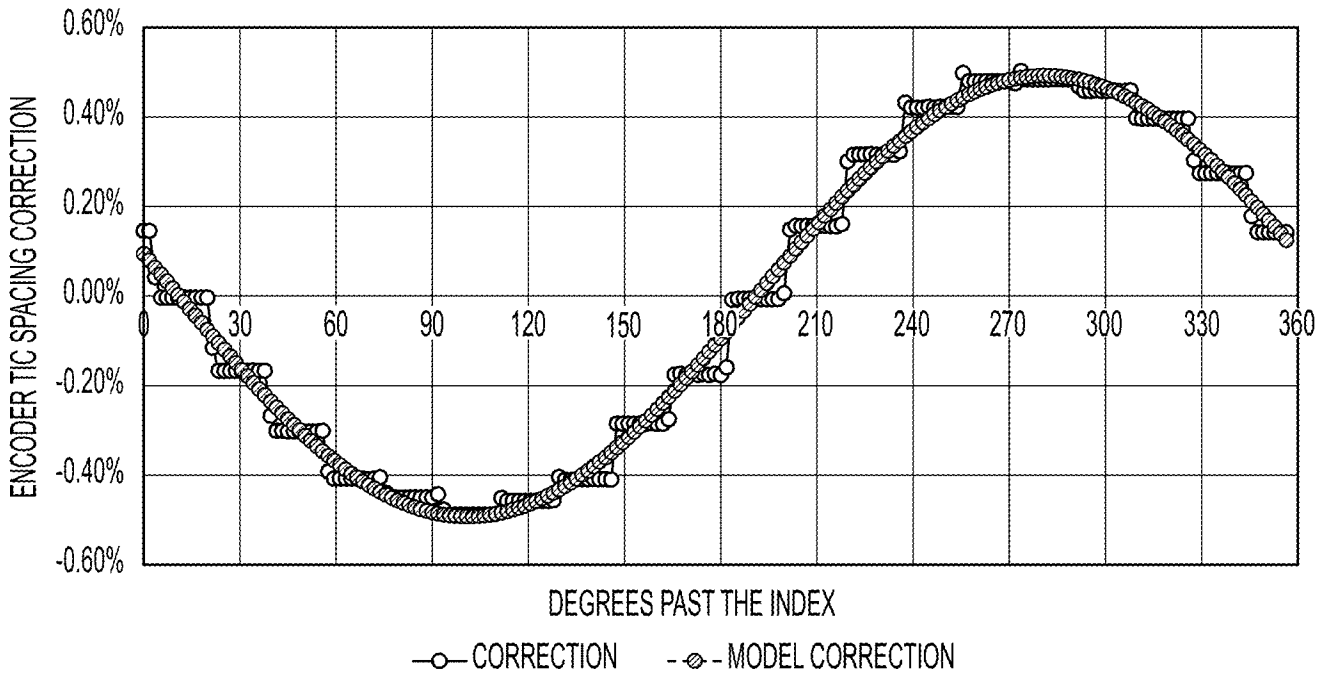
FIG. 4 is a graph of calculated runout, based on the logged runout data shown in FIG. 3, associated with a encoder roll operatively associated with a media transport according to an exemplary embodiment of this disclosure.

The graph in FIG. 4 shows the calculated runout for a drive roll and encoder arrangement averaged over 300 revolutions of the drive roll, along with the best fit sinusoid: −0.0048 sin(2*pi( )*ticsPastIndex/20000)+0.0009 cos (2*pi( )*ticsPastIndex/20000. The amplitudes of the sin and cos terms were calculated during a diagnostic cycle, and saved to marker NonVolatileMemory. At cycle-up, a table is generated for the distance correction vs tics past the index. At each interrupt, the corrected value for the distance per encoder tic is downloaded to the FPGA.

Figure 5:
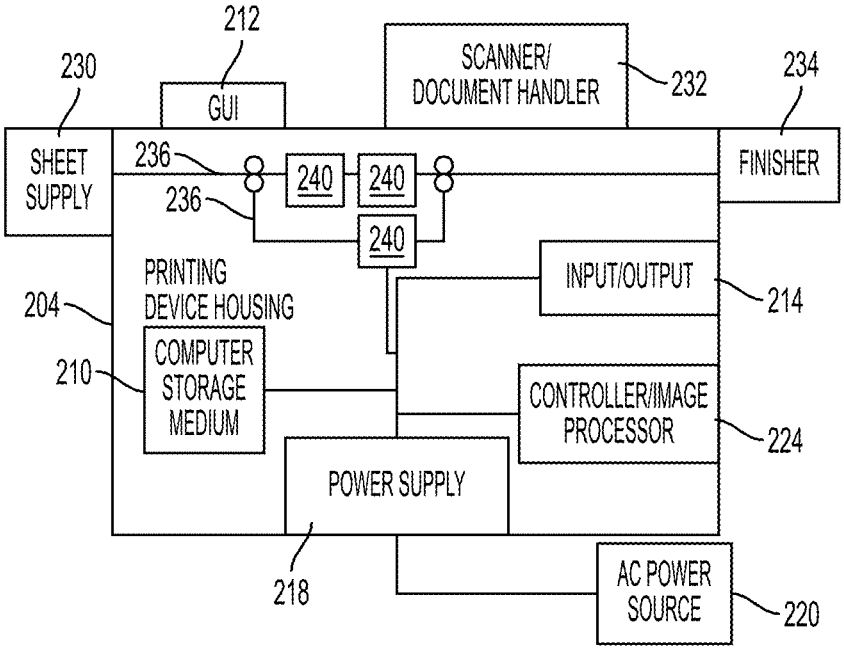
FIG. 5 is a block diagram of a printing apparatus according to an exemplary embodiment of this disclosure.

FIG. 5 illustrates an exemplary printing device 204, which can be used with systems and methods herein and can include, for example, a printer, copier, multi-function machine, multi-function device (MFD), etc. The printing device 204 includes a controller/tangible processor 224 and a communications port (input/output) 214 operatively connected to the tangible processor 224 and to the computerized network external to the printing device 204. Also, the printing device 204 can include at least one accessory functional component, such as a graphical user interface (GUI) assembly 212. The user may receive messages, instructions, and menu options from, and enter instructions through, the graphical user interface or control panel 212.

The input/output device 214 is used for communications to and from the printing device 204 and comprises a wired device or wireless device (of any form, whether currently known or developed in the future). The tangible processor 224 controls the various actions of the computerized device. A non-transitory, tangible, computer storage medium device 210 (which can be optical, magnetic, capacitor based, etc., and is different from a transitory signal) is readable by the tangible processor 224 and stores instructions that the tangible processor 224 executes to allow the computerized device to perform its various functions, such as those described herein. Thus, as shown in FIG. 5, a body housing has one or more functional components that operate on power supplied from an alternating current (AC) source 220 by the power supply 218. The power supply 218 can comprise a common power conversion unit, power storage element (e.g., a battery, etc.), etc.

The printing device 204 includes many of the components mentioned above and at least one marking device (printing engine(s)) 240 operatively connected to a specialized image processor 224 (that is different than a general purpose computer because it is specialized for processing image data), a media path 236 positioned to supply continuous media or sheets of media from a sheet supply 230 to the marking device(s) 240, etc. After receiving various markings from the printing engine(s) 240, the sheets of media can optionally pass to a finisher 234 which can fold, staple, sort, etc., the various printed sheets. Also, the printing device 204 can include at least one accessory functional component (such as a scanner/document handler 232 (automatic document feeder (ADF)), etc.) that also operate on the power supplied from the external power source 220 (through the power supply 218).

The one or more printing engines 240 are intended to illustrate any marking device that applies a marking material (toner, inks, plastics, organic material, etc.) to continuous media or sheets of media, whether currently known or developed in the future and can include, for example, devices that use a photoreceptor belt or an intermediate transfer belt, devices that print directly to print media (e.g., inkjet printers, ribbon-based contact printers, etc.), 3D printers, etc.

Figure 6:
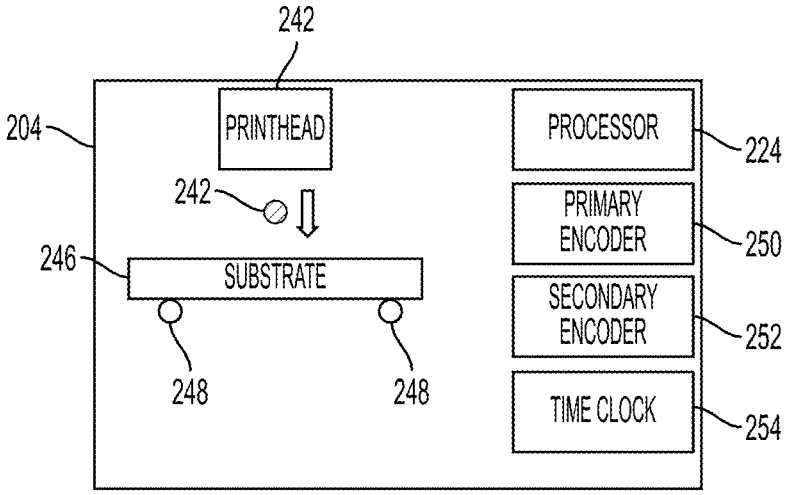
FIG. 6 is a block diagram of a media transport associated with a printing apparatus according to an exemplary embodiment of this disclosure.

As additionally shown in FIG. 6, the printing apparatuses 204 herein can include, among other components, any form of printhead 242, a processor 224 operatively connected to the printhead 242, a support 248 operatively connected to the processor 224, etc. The support 248 can comprise rollers, a plate or platform, etc., that supports a substrate 246 adjacent to the printhead 242. The printhead 242 transfers material in discrete units toward, or on to, the substrate 246. Further, such printing devices include a primary encoder 250 (e.g., distance counter) and a secondary encoder 252 (e.g., a time counter) also operatively connected to the processor 224. The primary encoder 250 counts in discrete distance increments as the substrate 246 moves relative to the printhead 242. The time counter 252 counts at regular time intervals correspond to time signals received by the time counter 252 from the time clock 254.

The processor 224 loads a firing distance into the distance counter 250. The firing distance is the distance from the current position of the printhead 242 to a marking location on the substrate 246. The distance counter 250 counts the firing distance in the discrete distance increments corrected for encoder runout as discussed herein, based on relative movement of the substrate 246 and the printhead 242.

The processor 224 loads the fractional remaining distance of the firing distance into the time counter 252 when the distance counter 250 reaches the last discrete distance increment of the firing distance. The fractional remaining distance is a distance less than one of the discrete distance increments. The time counter 252 counts the fractional remaining distance in the velocity-based distance increments at the regular time intervals. The processor 224 can determine the velocity-based distance increments based on the current relative velocity between the printhead 242 and the substrate 246. The printhead 242 transfers the marking material to the substrate 246 when the time counter 252 reaches the last velocity-based distance increment of the fractional remaining distance.

At the time that the fractional remaining distance is transferred to the time counter, the processor 224 can optionally add the next firing distance of a subsequent marking location and the fractional remaining distance, and supply the sum to the distance counter 250, when the printing apparatus repeats the processes of counting the firing distance, loading the fractional remaining distance, counting the fractional remaining distance, and transferring the marking material for the subsequent marking location.

Figure 7:
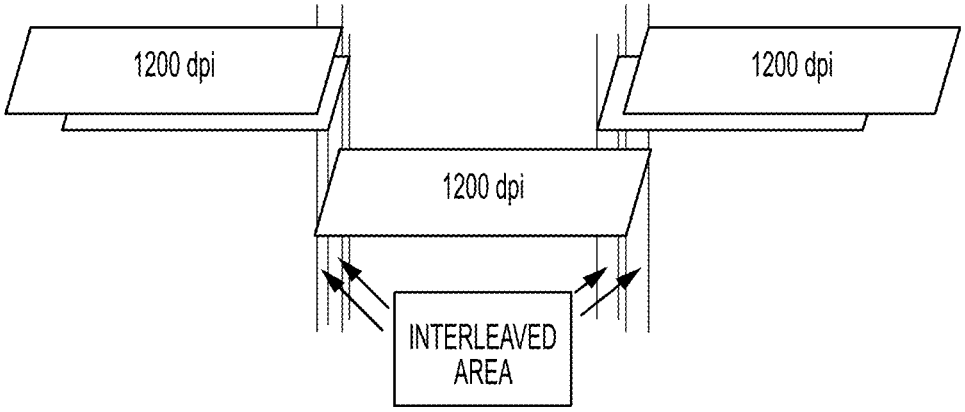
FIG. 7 is a block diagram of a marking station including interleaved printheads according to an exemplary embodiment of this disclosure.

FIG. 7 depicts an exemplary direct inkjet printer 300 that includes media supplies 304 and 308, a media path 312, a print zone 320, a media sheet conveyor 314, a spreader roller 332, a pressure roller 336, a media output tray 310, and a controller 390. The media supplies 304 and 308 are each configured to hold a plurality of media sheets and supply the media sheets to the printer via the media path 312 for printing. In the embodiment of printer 300, the media supplies 304 and 308 can hold media sheets of different sizes. In alternative configurations, either or both media supplies 304 and 308 hold media sheets having A4 size (210 mm.times.297 mm), legal size (216 mm.times.356 mm), tabloid size (279 mm.times.432 mm), letter, legal, A4, or tabloid size tabbed media sheets, or various other sheet sizes. Other embodiments can include more than two media supplies to enable the printer to store and print a variety of media sizes and types. Various printer embodiments move the media sheets in either a length or width orientation during printing. Thus, the "length" of a media sheet in the process direction can be either of the length or width dimensions commonly used to describe a media sheet size. For example, the length of a letter size media sheet in the process direction can be either 215.9 mm or 279.4 mm depending on the orientation of the media sheet as a media transport moves the media sheet in a process direction through the printer.

During a print job, media sheets from one or both of the media supplies 304 and 308 move along the media path 312. The media path 312 is a media transport that includes a plurality of guide rollers, such as guide rollers 316, which engage each media sheet and move the media sheets through the printer 300. In FIG. 7, the media path 312 guides each media sheet past a print zone 320 in a process direction for imaging operations on a first side of each media sheet. A portion of the media path 312' reverses an orientation of the media sheets and directs the media sheets through the print zone 320 a second time in the process direction to enable the print zone 320 to print ink images during imaging operations on the second side of each media sheet. As described in more detail below, a portion of the media path 312 between the print zone 320 and the rollers 332 and 336 includes a series of variable speed conveyors 314.

The print zone 320 includes a plurality of printheads arranged in a cross-process direction across a width of each media sheet. In FIG. 7, the print zone 320 includes a total of eight marking stations configured to print color images using a combination of cyan, magenta, yellow, and black (CMYK) inks. In the print zone 320, marking stations 322A and 322B print magenta ink, marking stations 324A and 324B print cyan ink, marking stations 326A and 326B print yellow ink, and marking stations 328A and 328B print black ink. Various alternative configurations print with a single color of ink, or include different ink colors including spot colors. Each of the marking stations 322A-328B includes a plurality of printheads, each one of which includes a plurality of inkjets.

The printheads in each set of marking stations 322A-322B, 324A-324B, 326A-326B and 328A-328B are arranged in interleaved and staggered arrays to enable printing over the entire cross-process width of a media sheet. For example, marking station 322A includes one array of printheads that print images at a resolution of 600-1200 drops per inch (DPI) in the cross-process direction over a media sheet. Each printhead in the array covers a portion of the width of the media sheet. Marking station 322B includes a second staggered array of printheads that are interleaved with the printheads in the marking station 322A to enable both of the marking stations to print magenta ink across the entire width of the media with a resolution of 600 DPI in the cross-process direction, as shown in FIG. 7.

In the print zone 320, the printheads in each marking station eject liquid drops of a phase change ink. In one embodiment, the ink is supplied as a series of solid ink sticks to each of the marking stations 322A-328B. A heater positioned in each marking station melts the ink to supply liquefied ink to the corresponding printhead array. As depicted in FIG. 8, each marking station includes a set of supporting electronics 323. The electronics 323 include driver electronics, which generate the signals that operate the printheads in the marking station 322A. The printheads are also supplied with ink from a supply. In one alternative configuration, two marking stations that print a single color of ink receive melted solid ink from a single supply. In another alternative configuration, the phase change ink is supplied in a plurality of granular pastilles rather than in the form of ink sticks. While printer 300 is depicted as using a phase-change ink, the methods described herein can also be used in xerographic printers using oiled fuser systems, to offset printers using oiled offset systems, and to inkjet printers using alternative forms of ink including aqueous, gel, solvent based, and UV curable inks.

A media sheet moves through the print zone 320 to receive an ink image and the media path 312 moves the media sheet out of the print zone 320 in the process direction. The printheads in marking stations 322A-328B print ink drops onto a predetermined area of the surface of the media sheet as the media sheet moves through the print zone to form an ink image on the media sheet. A section of the media path 312 located after the print zone 320 includes one or more conveyors 314. The conveyors 314 are configured to control the velocity of the media sheet in the process direction as the media sheet approaches a nip 334 formed between spreader roller 332 and pressure roller 336 and to shift the media sheet in the cross-process direction. As described in more detail below, the printer 300 controls the rotation of the rollers 332 and 336 and the movement of media sheets on the conveyors 314 to enable each media sheet to pass through the nip 334 with minimal re-transfer of release agent to a non-imaged side of the media sheet during duplex print operations.

Figure 9:
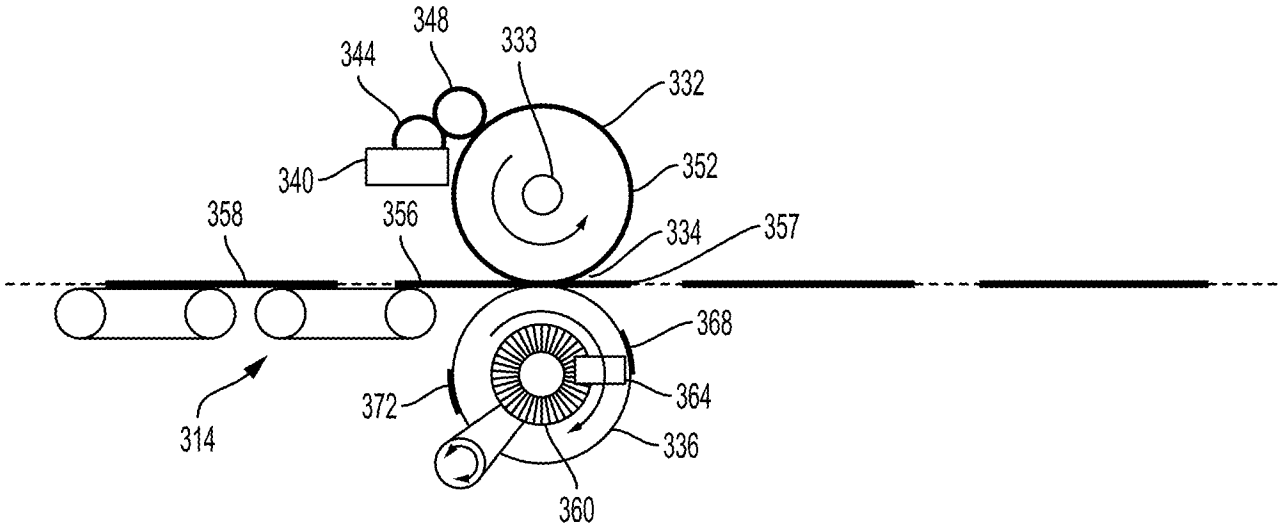
FIG. 9 is a diagram of an encoder/roller arrangement associated with a media transport according to an exemplary embodiment of this disclosure.

FIG. 9 depicts an exemplary set of rollers 332 and 336 in the printer 300. Media sheets pass through the nip 334 formed between the rollers 332 and 336. In the embodiment of printer 300, both the spreader roller 332 and pressure roller 336 apply pressure to media sheets as the media sheets pass through the nip 334. The spreader roller 332 engages the side of the media sheet that carries the ink drops formed on the sheet in the print zone, and the pressure applied to the media sheet spreads and fixes the ink to the media sheet. An actuator 333 rotates the spreader roller 332 to move media sheets in the process direction, and the friction between the rollers generates a counter-rotation in the pressure roller 336. In other embodiments, a separate drive motor rotates the pressure roller 336 to position the pressure roller 336 accurately during periods when the nip is split or opened, for example, between print jobs. The side of each media sheet holding an ink image printed in the print zone 320 contacts the spreader roller 332, while pressure roller 336 contacts the opposite side of the media sheet. The rollers 332 and 336 apply pressure, and optionally heat, to the media sheet as the media sheet moves through the nip 334. The pressure and heat flatten individual ink drops formed on the media sheet so that the ink image formed on the media sheet is "fixed" to the sheet in a durable manner.

During operation, the rotational position of the pressure roller 336 is monitored by a rotational sensor including an optical encoder disk 360, according to an exemplary embodiment, and a sensor 364. The optical encoder disk is axially mounted to the pressure roller 336 and rotates with the pressure roller 336. As the optical encoder disk 360 rotates, the encoder 360 interrupts a light beam generated in the sensor 364, which generates signals corresponding to the interruptions in the light beam. The signals generated in the sensor 364 identify both the rotational velocity of the pressure roller 336 and the rotational position of the pressure roller 336. In an alternative embodiment, the optical encoder disk includes a predetermined pattern of light and dark segments that alter the reflection of light from the surface of the optical disk to the sensor 364 as the optical encoder rotates. In still another embodiment, the pressure roller 336 is configured with a Hall Effect sensor.

The printer controller is configured to operate the media transport to position a media sheet that is different than a previous media sheet at a position to enable the portions of the second side of the media sheet that are to receive ink drops in the second-side printing operation to receive minimal release agent transfer during the first-side imaging operation. The controller operates a plurality of actuators in the media transport to position the media sheet at the desired position longitudinally on the pressure or transfix roller. The actuators move the media sheet into the nip to enable the media sheet to enter the nip at a location that minimizes the potential for pixel dropout on the second side of the media sheet.

Some portions of the detailed description herein are presented in terms of algorithms and symbolic representations of operations on data bits performed by conventional computer components, including a central processing unit (CPU), memory storage devices for the CPU, and connected display devices. These algorithmic descriptions and representations are the means used by those skilled in the data processing arts to most effectively convey the substance of their work to others skilled in the art. An algorithm is generally perceived as a self-consistent sequence of steps leading to a desired result. The steps are those requiring physical manipulations of physical quantities. Usually, though not necessarily, these quantities take the form of electrical or magnetic signals capable of being stored, transferred, combined, compared, and otherwise manipulated. It has proven convenient at times, principally for reasons of common usage, to refer to these signals as bits, values, elements, symbols, characters, terms, numbers, or the like.

It should be understood, however, that all of these and similar terms are to be associated with the appropriate physical quantities and are merely convenient labels applied to these quantities. Unless specifically stated otherwise, as apparent from the discussion herein, it is appreciated that throughout the description, discussions utilizing terms such as "processing" or "computing" or "calculating" or "determining" or "displaying" or the like, refer to the action and processes of a computer system, or similar electronic computing device, that manipulates and transforms data represented as physical (electronic) quantities within the computer system's registers and memories into other data similarly represented as physical quantities within the computer system memories or registers or other such information storage, transmission or display devices.

The exemplary embodiment also relates to an apparatus for performing the operations discussed herein. This apparatus may be specially constructed for the required purposes, or it may comprise a general-purpose computer selectively activated or reconfigured by a computer program stored in the computer. Such a computer program may be stored in a computer readable storage medium, such as, but is not limited to, any type of disk including floppy disks, optical disks, CD-ROMs, and magnetic-optical disks, read-only memories (ROMs), random access memories (RAMs), EPROMs, EEPROMs, magnetic or optical cards, or any type of media suitable for storing electronic instructions, and each coupled to a computer system bus.

The algorithms and displays presented herein are not inherently related to any particular computer or other apparatus. Various general-purpose systems may be used with programs in accordance with the teachings herein, or it may prove convenient to construct more specialized apparatus to perform the methods described herein. The structure for a variety of these systems is apparent from the description above. In addition, the exemplary embodiment is not described with reference to any particular programming language. It will be appreciated that a variety of programming languages may be used to implement the teachings of the exemplary embodiment as described herein.

A machine-readable medium includes any mechanism for storing or transmitting information in a form readable by a machine (e.g., a computer). For instance, a machine-readable medium includes read only memory ("ROM"); random access memory ("RAM"); magnetic disk storage media; optical storage media; flash memory devices; and electrical, optical, acoustical or other form of propagated signals (e.g., carrier waves, infrared signals, digital signals, etc.), just to mention a few examples.

The methods illustrated throughout the specification, may be implemented in a computer program product that may be executed on a computer. The computer program product may comprise a non-transitory computer-readable recording medium on which a control program is recorded, such as a disk, hard drive, or the like. Common forms of non-transitory computer-readable media include, for example, floppy disks, flexible disks, hard disks, magnetic tape, or any other magnetic storage medium, CD-ROM, DVD, or any other optical medium, a RAM, a PROM, an EPROM, a FLASH-EPROM, or other memory chip or cartridge, or any other tangible medium from which a computer can read and use.

Alternatively, the method may be implemented in transitory media, such as a transmittable carrier wave in which the control program is embodied as a data signal using transmission media, such as acoustic or light waves, such as those generated during radio wave and infrared data communications, and the like.

It will be appreciated that variants of the above-disclosed and other features and functions, or alternatives thereof, may be combined into many other different systems or applications. Various presently unforeseen or unanticipated alternatives, modifications, variations or improvements therein may be subsequently made by those skilled in the art which are also intended to be encompassed by the following claims.

What is claimed is:

1. A method for correcting for encoder runout associated with a printing device, the printing device including one or more printheads and a substrate transport including an encoder and encoder roller operatively associated with detecting a plurality of discrete angular positions of the encoder roller representative of a distance traveled by the substrate transport in a process direction towards the one or more printheads for marking a substrate with marking material carried by the substrate transport, the method comprising:

loading a firing distance into a distance counter operatively associated with the printing device, the firing distance being a distance from a current position of a printhead of the printing device to a marking location on the substrate, the distance counter counting the firing distance in discrete distance increments using encoder runout distance data based on a clock count between discrete angular positions of a transport roller operatively associated with the printing device and representative of distances between discrete angular positions of the transport roller based on movement of said substrate relative to said printhead;

loading a fractional remaining distance of the firing distance into a time counter operatively associated with the printing device when the distance counter reaches a last discrete distance increment of the firing distance;

counting the fractional remaining distance based on velocity-based calculated distance increments at regular time intervals using the time counter; and transferring material from the printhead to the substrate when the time counter reaches a last velocity-based distance increment of the fractional remaining distance, wherein the encoder runout distance data is generated during one or more of a power-up cycle, maintenance cycle and registration calibration process; the encoder runout data is generated from a data log generated while the substrate transport is driven in the process direction, the data log data is acquired at a series of data acquisition times and for each data acquisition time the data log data includes data for each representation of an encoder count log, an index count log, a clkSumPrevLog and angular position tics past an encoder roller index; and the encoder runout data is one of a data table and mathematical equation generated by a sin and cos function based on a best fit of the data log data.

2. The method according to claim 1, further comprising determining the velocity-based distance increments based on a current relative velocity between said printhead and the substrate.

3. The method according to claim 1, wherein the fractional remaining distance includes a distance less than one of said discrete distance increments.

4. The method according to claim 1, wherein the regular time intervals correspond to time signals received from a time clock of the printing device.

5. The method according to claim 1, further comprising:

adding a next firing distance of a subsequent marking location and the fractional remaining distance to the distance counter, and repeating the counting of the firing distance, the loading of the fractional remaining distance, the counting of the fractional remaining distance, and the transferring of the material from the printhead to the substrate at the subsequent marking location.

6. The method according to claim 1, wherein the substrate is one of a cut-sheet, an intermediate image transfer belt and a continuous feed sheet, and the transport roller is one of a drive roller, a nip roller and a tensioner roller.

7. A method for correcting for encoder runout associated with a printing device, the printing device including one or more printheads and a substrate transport including an encoder and encoder roller operatively associated with detecting a plurality of discrete angular positions of the encoder roller representative of a distance traveled by the substrate transport in a process direction towards the one or more printheads for marking a substrate with marking material carried by the substrate transport, the method comprising:

loading a firing distance into a distance counter operatively associated with the printing device, the firing distance being a distance from a current position of a printhead of the printing device to a marking location on the substrate;

the distance counter counting the firing distance in discrete distance increments using encoder runout distance data based on a clock count between discrete angular positions of a transport roller operatively associated with the printing device and representative of distances between discrete angular positions of the transport roller based on movement of said substrate relative to said printhead;

loading a fractional remaining distance of the firing distance into a time counter operatively associated with the printing device when the distance counter reaches a last discrete distance increment of the firing distance and adding a next firing distance of a subsequent marking location and the fractional remaining distance to the distance counter;

counting the fractional remaining distance based on velocity-based distance increments at regular time intervals using the time counter;

transferring material from the printhead to the substrate when the time counter reaches a last velocity-based distance increment of the fractional remaining distance; and repeating the counting of the firing distance, the loading of the fractional remaining distance, the counting of the fractional remaining distance, and the transferring of the material for the subsequent marking location, wherein the encoder runout distance data is generated during one or more of a power-up cycle, maintenance cycle and registration calibration process; the encoder runout data is generated from a data log generated while the substrate transport is driven in the process direction, the data log data is acquired at a series of data acquisition times and for each data acquisition time the data log data includes data for each representation of an encoder count log, an index count log, a clkSumPrevLog and angular position tics past an encoder roller index; and the encoder runout data is one of a data table and mathematical equation generated by a sin and cos function based on a best fit of the data log data.

8. The method according to claim 7, further comprising determining the velocity-based calculated distance increments based on a current relative velocity between the printhead and the substrate.

9. The method according to claim 7, wherein the fractional remaining distance includes a distance less than one of the discrete distance increments.

10. The method according to claim 7, wherein the regular time intervals correspond to time signals received from a time clock of the printing device.

11. The method according to claim 7, further comprising compensating for thermal expansion by marking a distance amount of the discrete distance increments a function of temperature of the substrate.

12. The method according to claim 7, wherein the substrate is one of a cut-sheet, an intermediate image transfer belt and a continuous feed sheet, and the transport roller is one of a drive roller, a nip roller and a tensioner roller.

13. A method for correcting for encoder runout associated with a printing device, the printing device including one or more printheads, and a substrate transport including a transport belt driven in a process direction towards the one or more printheads and the substrate transport including an encoder and encoder roller operatively associated with detecting a plurality of discrete angular positions of the encoder roller representative of a distance traveled by the transport belt in the process direction towards the one or more printheads for marking a substrate with marking material carried by the transport belt, the method comprising:

loading a firing distance into a distance counter operatively associated with the printing device, the firing distance being a distance from a current position of a printhead of the printing device to a marking location on the substrate, the distance counter counting the firing distance in discrete distance increments using encoder runout distance data based on a clock count between discrete angular positions of the encoder roller operatively associated with the printing device and representative of distances between discrete angular positions of the encoder roller based on movement of said substrate relative to said printhead;

loading a fractional remaining distance of the firing distance into a time counter operatively associated with the printing device when the distance counter reaches a last discrete distance increment of the firing distance;

counting the fractional remaining distance based on velocity-based calculated distance increments at regular time intervals using the time counter; and transferring material from the printhead to the substrate when the time counter reaches a last velocity-based distance increment of the fractional remaining distance;

wherein the encoder runout distance data is generated during one or more of a power-up cycle, maintenance cycle and registration calibration process; the encoder runout data is generated from a data log generated while the substrate transport belt is driven in the process direction, the data log data is acquired at a series of data acquisition times and for each data acquisition time the data log data includes data for each representation of an encoder count log, an index count log, a clkSumPrevLog and angular position tics past an encoder roller index; and the encoder runout data is one of a data table and mathematical equation generated by a sin and cos function based on a best fit of the data log data.

14. The method according to claim 13, further comprising determining the velocity-based distance increments based on a current relative velocity between said printhead and the substrate.

15. The method according to claim 13, wherein the fractional remaining distance includes a distance less than one of said discrete distance increments.

16. The method according to claim 13, wherein the regular time intervals correspond to time signals received from a time clock of the printing device.

17. The method according to claim 13, further comprising:

adding a next firing distance of a subsequent marking location and the fractional remaining distance to the distance counter, and repeating the counting of the firing distance, the loading of the fractional remaining distance, the counting of the fractional remaining distance, and the transferring of the material from the printhead to the substrate at the subsequent marking location.

18. The method according to claim 13, wherein the substrate is one of a cut-sheet, an intermediate image transfer belt and a continuous feed sheet, and the transport roller is one of a drive roller, a nip roller and a tensioner roller.

* * * * *